US006742920B2

(12) United States Patent
Takada et al.

(10) Patent No.: US 6,742,920 B2
(45) Date of Patent: Jun. 1, 2004

(54) VEHICLE HEADLAMP HAVING EXTENDED ILLUMINATION ON BOTH SIDES OF A HORIZONTAL CUT-LINE

(75) Inventors: Kenichi Takada, Shizuoka (JP); Naoki Uchida, Shizuoka (JP); Hiroyuki Ishida, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 56 days.

(21) Appl. No.: 10/156,133

(22) Filed: May 29, 2002

(65) Prior Publication Data

US 2002/0181246 A1 Dec. 5, 2002

(30) Foreign Application Priority Data

May 30, 2001 (JP) ..... P.2001-162372

(51) Int. Cl.[7] ..... F21V 11/16
(52) U.S. Cl. ..... 362/539; 362/507; 362/351
(58) Field of Search ..... 362/459, 487, 362/496, 506, 507, 509, 512, 513, 538, 539, 257, 261, 263, 268, 317, 341, 342–350, 351, 464, 465–468, 473, 475

(56) References Cited

U.S. PATENT DOCUMENTS

| | | | | | |
|---|---|---|---|---|---|
| 4,928,214 | A | * | 5/1990 | Oyama | 362/539 |
| 4,953,063 | A | | 8/1990 | Nino | |
| 5,171,082 | A | | 12/1992 | Watanabe | |
| 5,673,990 | A | * | 10/1997 | Neumann et al. | 362/539 |
| 6,168,297 | B1 | * | 1/2001 | Tatsukawa | 362/539 |
| 6,354,718 | B1 | * | 3/2002 | Iwaki et al. | 362/539 |

* cited by examiner

*Primary Examiner*—Sandra O'Shea
*Assistant Examiner*—Ismael Negron
(74) *Attorney, Agent, or Firm*—Sughrue Mion, PLLC

(57) ABSTRACT

A vehicular headlamp includes a light source, a reflector for radiating light emitted from the light source forwards, and a cover lens for covering an area in front of the reflector and the light source, wherein the light distribution pattern of the low beam emitted by the vehicular headlamp has a horizontal cut line at least on the side of the opposite lane and wherein a long-distance visibility enchancing portion extending above the horizontal cut line of the light distribution pattern is formed at an end portion of the horizontal cut line.

6 Claims, 6 Drawing Sheets

VEHICLE HEADLAMP HAVING EXTENDED ILLUMINATION ON BOTH SIDES OF A HORIZONTAL CUT-LINE

BACKGROUND OF THE INVENTION

The present invention relates to a vehicular headlamp. More specifically, the invention relates to a headlamp having improved long-distance visibility in right and left diffused-beam areas without dazzling the vision of drivers of oncoming vehicles.

FIG. 6 shows a light distribution pattern obtained from a vehicular headlamp according to the conventional practice radiated onto a screen disposed in front of the vehicle. In FIG. 6, H—H notes a horizontal line and that V—V denotes a vertical line extending perpendicularly to the horizontal line H—H.

The low beam of the headlamp, used when approaching an oncoming vehicle or driving in a city area, forms a light distribution pattern a. A horizontal cut line b, defining an upper boundary of the light distribution pattern a, generally assumes the shape of flattened "Z". The horizontal cut line b is located below the horizontal line H—H on the side of the opposite lane with respect to the vertical line V—V (i.e., on the right side in countries where vehicles are required by law to keep to the left). The horizontal cut line b on the side of one's own lane (i.e., on the left side in those countries) is located above the line on the side of the opposite lane. By shaping the horizontal cut line b as described above, it is possible to effectively illuminate one's own lane without dazzling drivers of oncoming vehicles or pedestrians. In countries where vehicles are required to keep to the right, the cut line b is of course located on the left side of the vertical line V—V.

The horizontal cut line b of the light distribution pattern of a low beam emitted from the aforementioned vehicular headlamp according to the conventional practice differs in height when viewed in the lateral direction, but extends horizontally as a whole. For this reason, the aforementioned vehicular headlamp is confronted by a problem of insufficient long-distance visibility.

Concerning the opposite lane, it is obviously necessary to set the horizontal cut line b so as to prevent the vision of drivers of oncoming vehicles from being dazzled. However, as far as illumination of an area outside one's own lane or the opposite lane is concerned, light should be radiated in a region extending above the horizontal cut line b in right and left diffused-beam areas of the light distribution pattern a so as, for example, to improve visibility far ahead of one's own vehicle when driving along a leftward curve (in the case where vehicles are required by law to keep to the left) so as to allow the driver to better see pedestrians to the side of the road far ahead and well in advance.

The present invention has been made in consideration of the aforementioned circumstances. It is an object of the present invention to provide a headlamp having improved long-distance visibility in right and left diffused-beam areas without dazzling drivers of oncoming vehicles.

SUMMARY OF THE INVENTION

In order to achieve the above and other objects, the present invention provides a vehicular headlamp comprising a light source, a reflector for radiating light emitted from the light source forwards, and a cover lens for covering an area in front of the reflector and the light source, wherein a light distribution pattern of a low beam emitted from the vehicular headlamp has a horizontal cut line at least on the side of the opposite lane, and wherein long-distance visibility enhancing portions extending above the horizontal cut line of the light distribution pattern are formed in end portions of the horizontal cut line.

Thus, the vehicular headlamp according to the present invention offers improved visibility of a distant range by means of the long-distance visibility enhancing portions extending above the horizontal cut line of the light distribution pattern, thus allowing the driver, for example, to better see pedestrians standing ahead in one's own lane along a curved road, or pedestrians standing outside either lane well before a dangerous situation could develop.

The long-distance visibility enhancing portions extending above the horizontal cut line of the light distribution pattern can be formed in different ways, including:

(1) a vehicular headlamp having a reflector for reflecting and condensing light emitted from a light source, a projection lens for projecting the light reflected by the reflector forwards, and a shade having an upper edge defining a horizontal cut line, wherein downward-extending portions extending further downwards than other portions are formed in right and left end portions of the upper edge of the shade, and wherein the long-distance visibility enhancing portions of a light distribution pattern are formed by the downward-extending portions of the shade;

(2) a vehicular headlamp having a stepped reflector with its entire reflecting surface divided into small reflecting sections, each of which distributes light emitted from the light source to a predetermined position so as to form a predetermined light distribution pattern, wherein light reflected by some of the reflecting sections of the stepped reflector form the long-distance visibility enhancing portions of the light distribution pattern; and (3) a vehicular headlamp wherein a control portion formed in the cover lens directs some of the light reflected by the reflector to form the long-distance visibility enhancing portions.

DESCRIPTION OF THE PREFERRED EMBODIMENTS

Preferred embodiments of a vehicular headlamp constructed according to the present invention will be described hereinafter with reference to the accompanying drawings.

Figure 1:
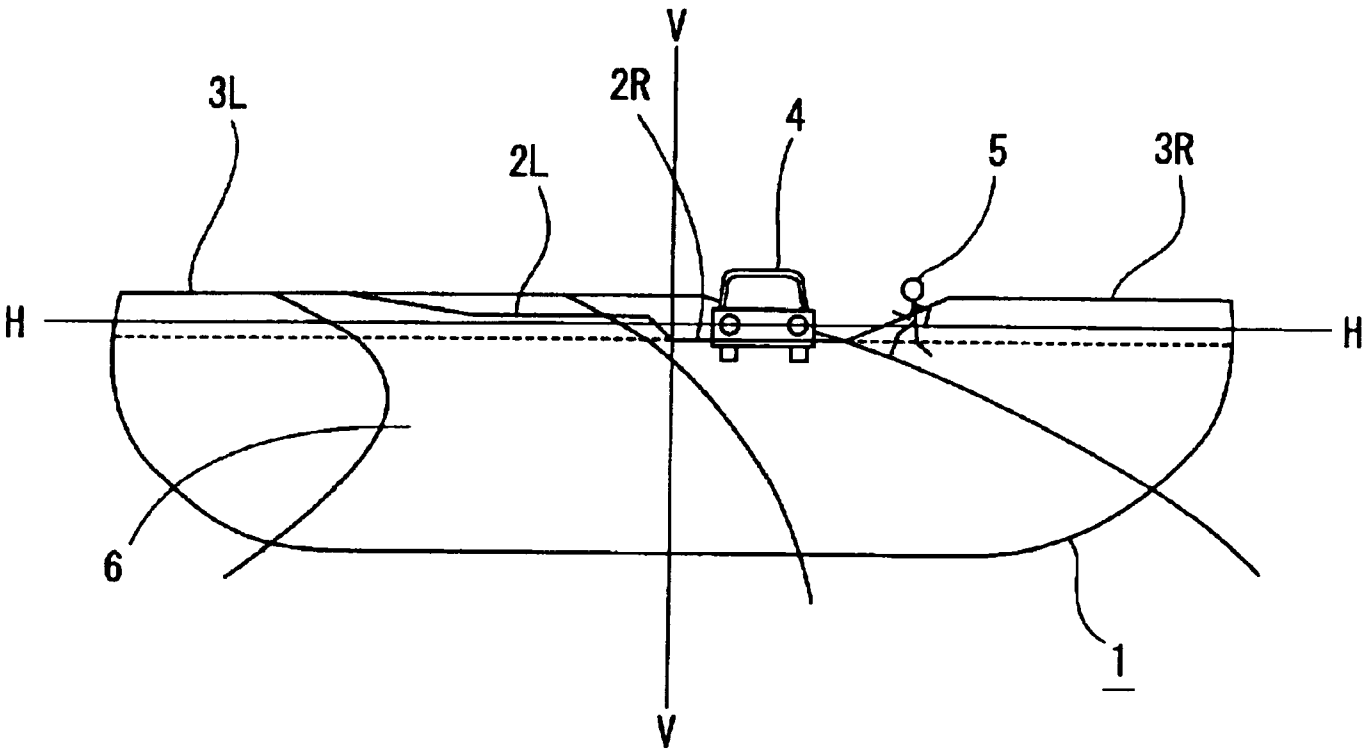
FIG. 1 shows a light distribution pattern obtained with a vehicular headlamp constructed according to the present invention.
Figure 6:
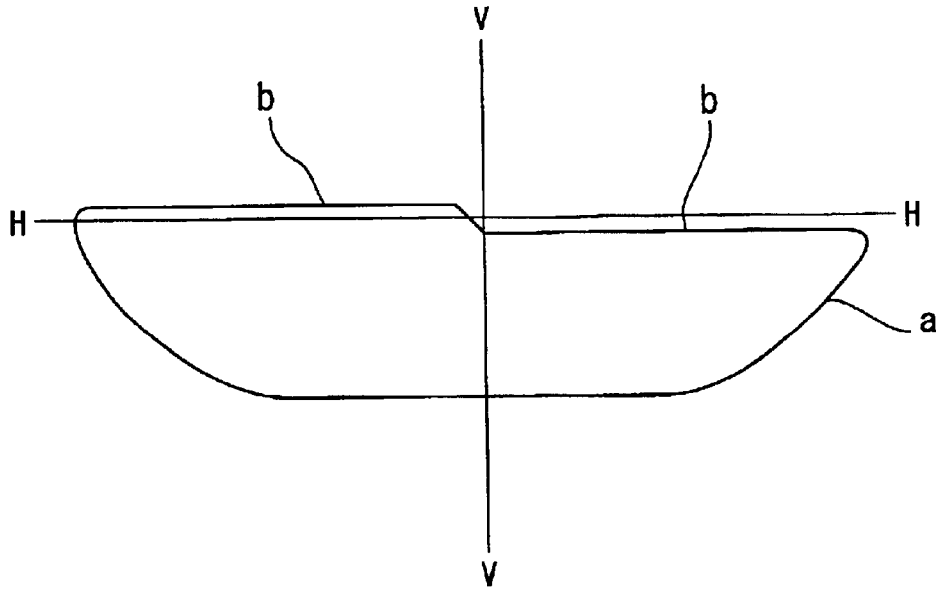
FIG. 6 PRIOR ART
FIG. 6 shows a light distribution pattern obtained with a conventional vehicular headlamp.

FIG. 1 shows a low-bean light distribution pattern produced by a vehicular headlamp according to the present invention. This light distribution pattern is illustrated in the same manner as the light distribution pattern shown in FIG. 6.

The light distribution pattern 1 has a horizontal cut line 2R in an area for illumination of the opposite lane of a straight road, and long-distance visibility enhancing portions 3R, 3L designed for illumination of portions above an extension (indicated by a broken line) of the horizontal cut line 2R in right and left diffused-beam areas, respectively.

The horizontal line 2R prevents the driver of an oncoming vehicle 4 from being dazzled. The long-distance visibility enhancing portions 3R, 3L ensure improved visibility in the right and left diffused-beam areas, respectively, and thus allow the driver to better see a pedestrian 5 standing outside the opposite lane well before a dangerous situation could develop, that is to allow the driver sufficient time to be prepared for an emergency situation ahead in one's own lane 6 in advance while driving along a curve. Accordingly, the light distribution pattern 1 of the low beam radiated by the vehicular headlamp according to the present invention contributes significantly to the assurance of safe driving.

It is desirable that the horizontal cut line extend from a central area of the light distribution pattern through an angle of approximately 10° to the right (i.e., towards the opposite lane) of the center direction, and that the long-distance visibility enhancing portion be formed beyond this range. By adopting this construction, it becomes possible to provide the driver with improved visibility of pedestrians or the shoulders of the road.

Preferred embodiments of a vehicular headlamp for producing a low beam according to the light distribution pattern 1 will now be described.

Figure 2:
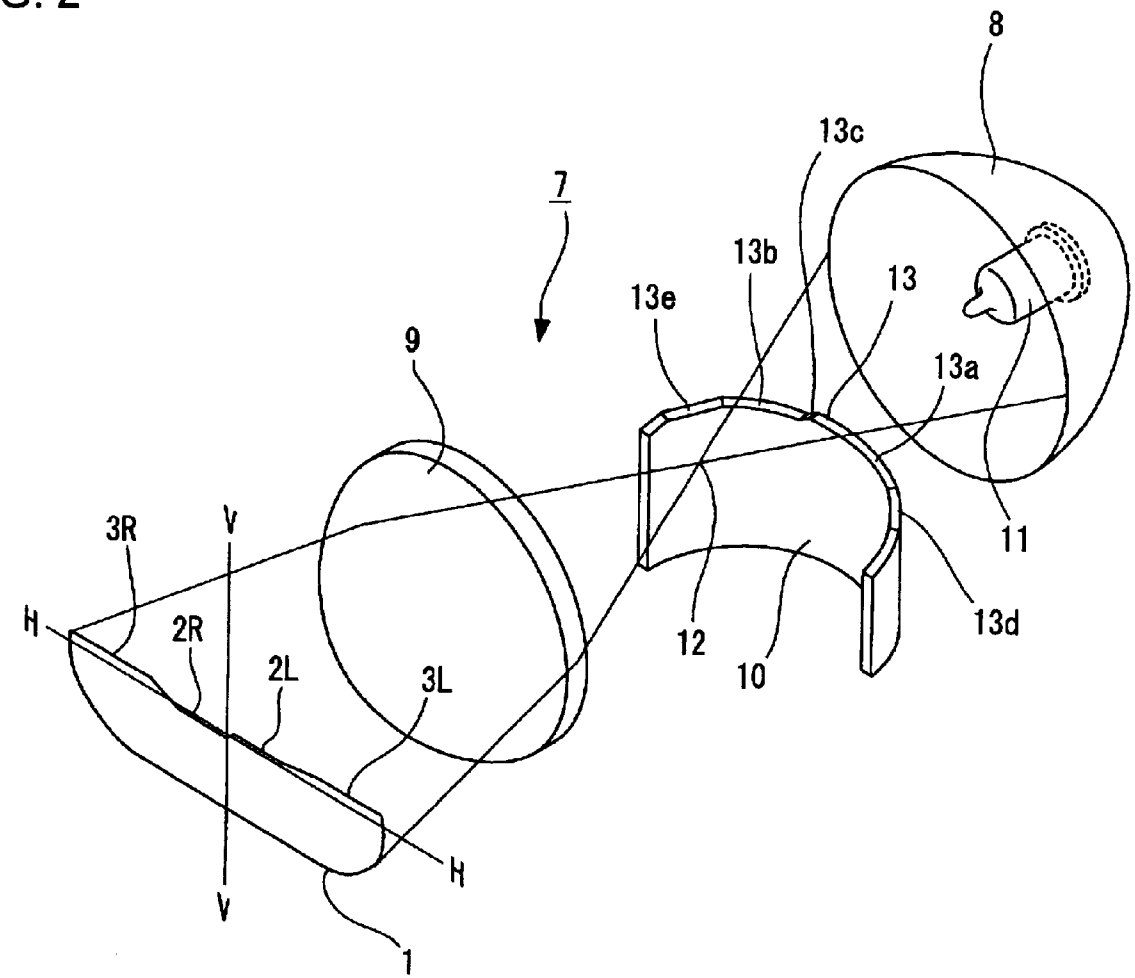
FIG. 2 is a schematic view of a vehicular headlamp constructed according to a first embodiment of the present invention, illustrating the concept of forming a light distribution pattern of the invention.
Figure 3:
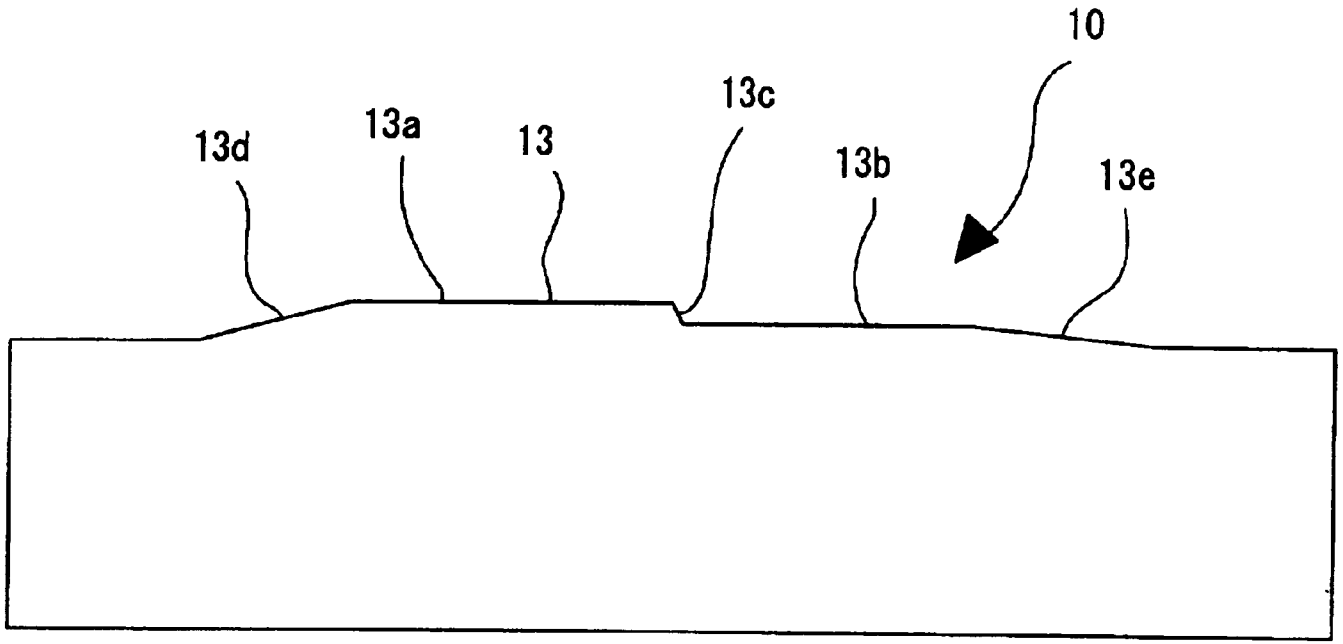
FIG. 3 is a front view of a shade used in the headlamp of the invention.

FIGS. 2 and 3 show a vehicular headlamp according to a first embodiment of the present invention.

A vehicular headlamp 7 according to the first embodiment is a so-called projector type headlamp. Main component members of the vehicular headlamp 7 include a reflector 8, a projection lens 9, a shade 10, and a light source 11.

The reflector 8 has a narrow beam-condensing range 12 when viewed in the vertical direction, and is designed to reflect light emitted from the light source 11 and condense it into the beam-condensing range 12. The projection lens 9 is designed to focus light diffused past the beam-condensing range 12 into a substantially parallel beam and project the beam forwards.

The vehicular headlamp 7 is provided with a lamp body and a cover lens, which define a space in which the aforementioned component members, that is, the reflector 8, the projection lens 9, the shade 10, and the light source 11, are disposed. The lamp body and the cover lens, which are themselves of a well-known and conventional design, are not shown in the drawings.

The shade 10 is disposed such that an upper edge 13 thereof is located close to the beam-condensing range. The upper edge 13 forms an upper cut line of the light distribution pattern 1 (i.e., the horizontal cut line 2R and upper edges of the long-distance visibility enhancing portions 3R, 3L). For this reason, the upper edge 13 of the shade 10 has a shape as shown in FIG. 3. That is, the horizontal cut line 2R, the left horizontal cut line 2L, the juncture between the horizontal cut lines 2R, 2L, the upper edge of the long-distance visibility enhancing portion 3R, and the upper edge of the long-distance visibility enhancing portion 3L are defined by portions 13*a*, 13*b*, 13*c*, 13*d*, and 13*e*, respectively.

Light reflected by the reflector is condensed in a region close to the upper edge of the shade 13 and diffused in the vicinity of the portions 13*e*, 13*d* of the shade, namely, the portions constituting the long-distance visibility enhancing portions. Therefore, light radiated toward the long-distance visibility enhancing portions past the portions 13*e*, 13*d* of the shade, namely, the portions constituting the long-distance visibility enhancing portions, are not so bright as to dazzle drivers of oncoming vehicles but are bright enough to improve the driver's visibility of pedestrians or the shoulders of the road.

Figure 4:
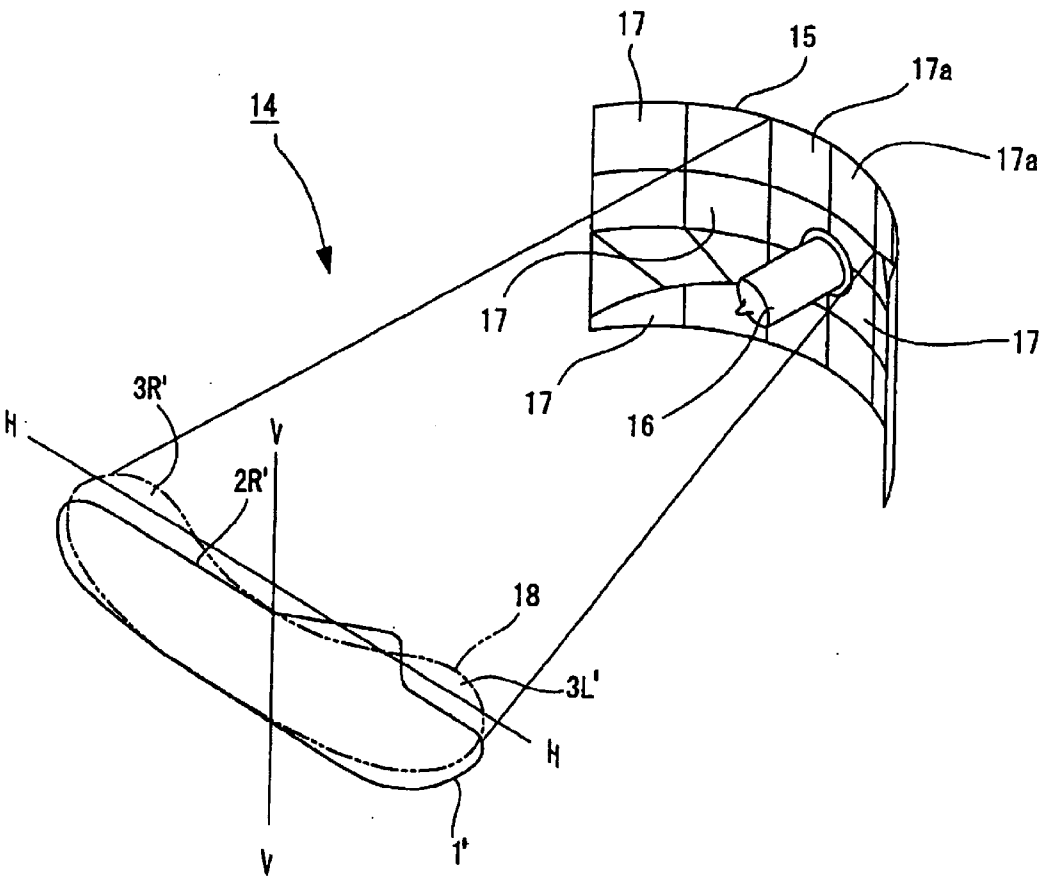
FIG. 4 is a schematic perspective view of a vehicular headlamp according to a second embodiment of the present invention.

FIG. 4 shows a vehicular headlamp constructed according to a second embodiment of the present invention.

A vehicular headlamp 14 according to the second embodiment includes a stepped reflector 15 and a light source 16.

The entire reflecting surface of the stepped reflector 15 is divided into small reflecting sections 17, to each of which a specific reflection property is assigned. The individual light reflected by the various reflecting sections 17 combine to constitute the low beam as a whole.

Some of the reflecting sections 17 of the stepped reflector 15 reflect light constituting the long-distance visibility enhancing portions 3R', 3L' of the light distribution pattern 1'. For example, light reflected by upper-central ones 17*a* of the reflecting sections 17 constitute the long-distance visibility enhancing portions 3R', 3L' of the light distribution pattern 1'. If images of the light source projected onto the reflecting sections 17*a* are extended laterally and extended slightly upwards, they form a pattern 18 (indicated by a chain double-dashed line in FIG. 4) as a whole after being reflected by the reflecting sections 17*a*. Upper-right and upper-left end portions of the pattern 18 constitute the long-distance visibility enhancing portions 3R', 3L' of the light distribution pattern 1', respectively.

It is appropriate, for example, that the vertical cross-sectional shape of a central portion of each of the reflecting sections 17*a* is formed as a paraboloid having the rear end of the filament as its focal point, and that the vertical cross-sectional shape of right and left end portions of each of the reflecting sections 17*a* is obtained by tilting a paraboloid upwards.

The images of the light source projected onto the reflecting sections 17*a* are relatively large and demonstrate low luminosity, laterally widely diffused patterns such as the pattern 18 can be formed easily, Also, owing to relatively low luminosity, the long-distance visibility enhancing portions 3R', 3L' cause no significant dazzle to pedestrians or the like.

The vehicular headlamp 14 according to the second embodiment is also provided with a lamp body and a cover lens, which are not shown in the drawings.

Figure 5:
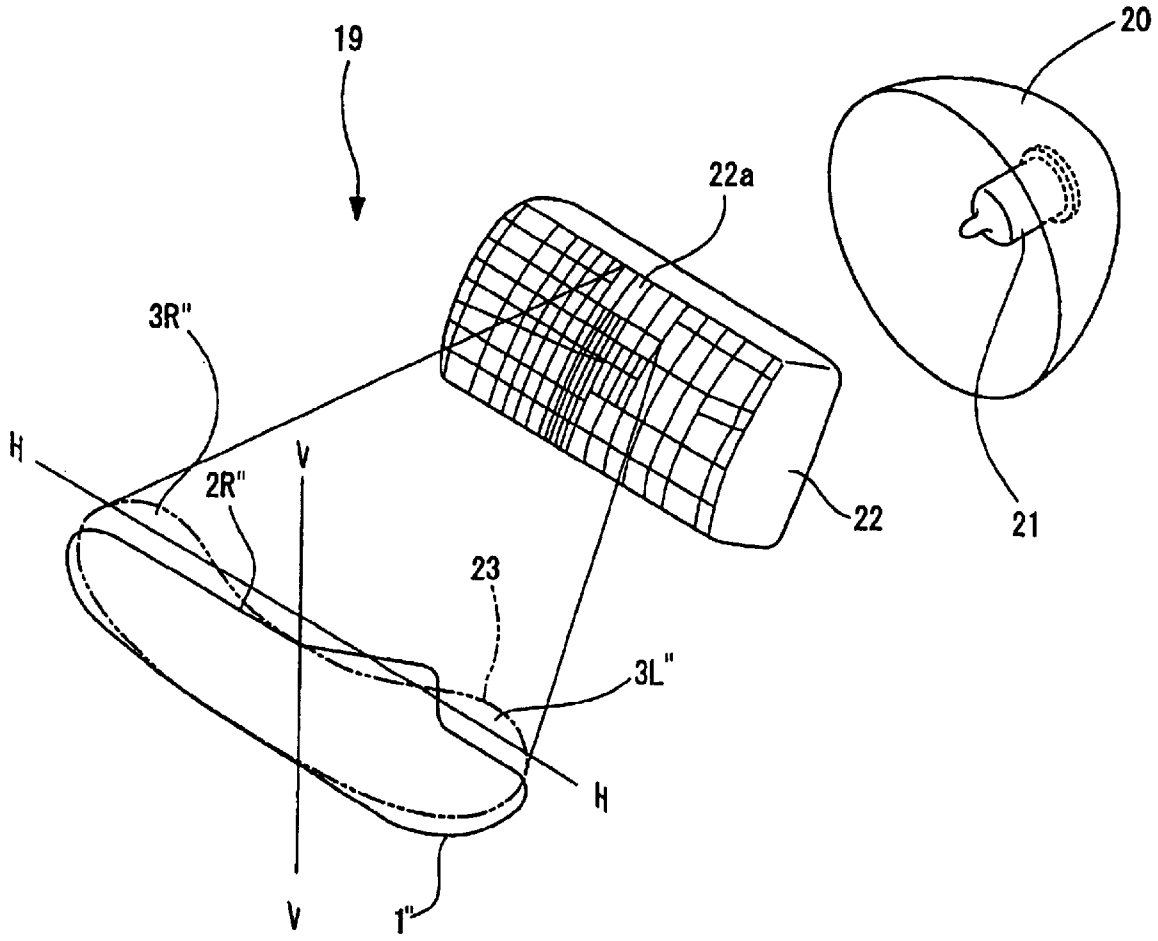
FIG. 5 is a schematic perspective view of a vehicular headlamp according to a third embodiment of the present invention.

FIG. 5 shows a vehicular headlamp according to a third embodiment of the present invention.

A vehicular headlamp 19 according to the third embodiment includes as main components a reflector 20, a light source 21, and a cover lens 22.

Lens steps are formed in at least one portion of the cover lens 22, for example, in a portion 22*a* constituting an upper-central portion of the reflector 20. Some of the light reflected by the reflector 20 forms a pattern 23 (indicated by a chain double-dashed line in FIG. 5) due to the control by the lens steps formed in the portion 22*a* of the cover lens 22. Upper-right and upper-left end portions of the pattern 23 constitute the long-distance visibility enhancing portions 3R", 3L" of the light distribution pattern 1", respectively.

The vehicular headlamp 19 according to the third embodiment is also provided with a lamp body, which is not shown in the drawings.

It is to be noted herein that the shapes and structures of all the component members mentioned in the aforementioned embodiments are to be regarded merely as examples in embodying the present invention, and that the technical scope of the present invention is not to be construed narrowly on grounds of those shapes and structures.

As is apparent from the foregoing description, the vehicular headlamp according to the present invention includes the light source, the reflector for radiating light emitted from the light source forwards, and the cover lens for covering the area in front of the reflector and the light source, wherein the light distribution pattern of the low beam emitted from the vehicular headlamp has a horizontal cut line at least on the side of the opposite lane. This headlamp is characterized in that long-distance visibility enhancing portions extending above the horizontal cut line of the light distribution pattern are formed in end portions of the horizontal cut line.

Thus, the vehicular headlamp according to the present invention offers improved visibility of a distant range by means of the long-distance visibility enhancing portions of the light distribution pattern extending above the horizontal cut line of the light distribution pattern, thereby allowing the driver to better see pedestrians standing at a position ahead in one's own lane along a curved portion of the road, or pedestrians standing outside either lane well before a potentially dangerous situation could occur.

It should further be apparent to those skilled in the art that various changes in form and detail of the invention as shown and described above may be made. It is intended that such changes be included within the spirit and scope of the claims appended hereto.

What is claimed is:

1. A vehicular headlamp comprising: a light source, a stepped reflector having a reflecting surface divided into small reflecting sections, each of which distributes light emitted from said light source to a predetermined direction so as to contribute a predetermined light distribution pattern having a horizontal cut line, some of said reflecting sections of said stepped reflector providing long-distance visibility enhancing portions of said light distribution pattern extending above said horizontal cut line of said light distribution pattern and formed at end portions of said horizontal cut line.

2. The vehicular headlamp according to claim 1, wherein said some of said reflecting sections comprise paraboloids tilted upward from said horizontal cut line of said light distribution pattern.

3. A vehicular headlamp comprising: a light source, a reflector for radiating light emitted from said light source forwards, a cover lens for covering an area in front of said reflector and said light source, wherein a light distribution pattern of a low beam emitted by said vehicular headlamp has a horizontal cut line at least on the side of an opposite lane, and a control portion formed in said cover lens for directing some light reflected by said reflector onto said cover lens to form long-distance visibility enhancing portions in said light distribution pattern extending above said horizontal cut line of said light distribution pattern and at end portions of said horizontal cut line.

4. The vehicular headlamp according to claim 3, wherein said control portion comprises a plurality of lens steps formed in an upper central portion of said lens cover.

5. A vehicular headlamp comprising: a light source, a reflector for radiating light emitted from said light source forwards, a cover lens for covering an area in front of said reflector and said light source, wherein a light distribution pattern of a low beam emitted by said vehicular headlamp has a horizontal cut line at least on the side of an opposite lane, and means for providing long-distance visibility enhancing portions in said light distribution pattern extending above said horizontal cut line of said light distribution pattern and formed at end portions of said horizontal cut line.

6. A vehicular headlamp comprising: a light source, a reflector for reflecting and condensing light emitted from said light source, a projection lens for projecting the light reflected by said reflector forwards, and a shade disposed forward of said light source and having an upper edge defining a horizontal cut line, wherein a light distribution pattern of a low beam emitted by said vehicular headlamp has a horizontal cut line at least on the side of an opposite lane, said shade comprising downward-extending portions extending further downwards than other portions formed in right and left end portions of said upper edge of the shade, long-distance visibility enhancing portions of said light distribution pattern being formed in accordance with said downward-extending portions of the shade.

* * * * *